US009024705B2

(12) United States Patent
Cheng et al.

(10) Patent No.: US 9,024,705 B2
(45) **Date of Patent: *May 5, 2015**

(54) CAVITY FILTER WITH HIGH FLATNESS FEEDBACK

(75) Inventors: Wei Cheng, Keelung (TW); Wei-Hong Hsu, Keelung (TW); Tsung-Han Chang, Keelung (TW)

(73) Assignee: Universal Microwave Technology, Inc., Keelung (TW)

( * ) Notice: Subject to any disclaimer, the term of this patent is extended or adjusted under 35 U.S.C. 154(b) by 296 days.

This patent is subject to a terminal disclaimer.

(21) Appl. No.: 13/592,163

(22) Filed: Aug. 22, 2012

(65) Prior Publication Data

US 2012/0313732 A1 Dec. 13, 2012

Related U.S. Application Data

(63) Continuation-in-part of application No. 13/115,643, filed on May 25, 2011, now Pat. No. 8,704,613.

(51) Int. Cl.

| | |
|---|---|
| ***H01P 1/213*** | (2006.01) |
| ***H01P 1/205*** | (2006.01) |
| ***H01P 1/208*** | (2006.01) |

(52) U.S. Cl.

CPC ..... *H01P 1/2136* (2013.01); *H01P 1/208* (2013.01); *H01P 1/205* (2013.01)

(58) Field of Classification Search

CPC ..... H01P 1/208; H01P 1/2136; H01P 1/2138; H01P 1/205

USPC ..... 333/126, 127, 202–212, 134

See application file for complete search history.

(56) References Cited

U.S. PATENT DOCUMENTS

| | | | | |
|---|---|---|---|---|
| 5,608,363 | A * | 3/1997 | Cameron et al. | 333/202 |
| 8,704,613 | B2 * | 4/2014 | Hsu et al. | 333/134 |
| 2009/0058563 | A1 * | 3/2009 | Seo et al. | 333/209 |

* cited by examiner

*Primary Examiner* — Benny Lee
*Assistant Examiner* — Rakesh Patel
(74) *Attorney, Agent, or Firm* — Muncy, Geissler, Olds & Lowe, P.C.

(57) ABSTRACT

A cavity filter having two series of resonance chambers bilaterally connected between an antenna port and two opposing signal input/output ports in a resonant space therein, each series of resonance chambers having the last resonance chamber thereof connected to the antenna port and the first resonance chamber thereof connected to the respective signal input/output port and kept in communication with the associating last resonance chamber through one respective channel and the second resonance chamber thereof kept in communication with the last second resonance chamber thereof through one respective channel to provide cross-coupling feedback, getting better stop-band flatness and improving signal quality.

4 Claims, 7 Drawing Sheets

CAVITY FILTER WITH HIGH FLATNESS FEEDBACK

This application is a Continuation-In-Part of application Ser. No. 13/115,643, filed on May 25, 2011, for which priority is claimed under 35 U.S.C. §120, the entire contents of which are hereby incorporated by reference.

BACKGROUND OF THE INVENTION

1. Field of the Invention:

The present invention relates to electronic signal filter technology and more particularly, to a cavity filter, which has two series of resonance chambers bilaterally connected between an antenna port and two opposing signal input/output ports in a resonant space to provide a cross-coupling feedback, getting better stop-band flatness and improving the quality of the signal received by the signal receiver using the cavity filter.

2. Description of the Related Art:

Following fast development of communication technology, many advanced wired and wireless signal transmitting and receiving equipment have been created and are widely used in different fields. However, due to limited wireless communication channels, full bandwidth utilization is quite important. For full bandwidth utilization, communication capacity and quality must be well improved. As different channels may be close to one another, channel isolation must be well done to prevent interference and to maintain signal transmission quality. For removing noises in a wireless communication application, a cavity filter is usually used. However, it is not easy to create a cavity that effectively removes noises and achieves excellent channel-to-channel isolation.

A regular bandpass cavity filter (duplexer) allows bi-directional communication of the energy at a particular frequency range over a single channel and attenuates the energy that is out of this particular frequency range. However, a cavity filter cannot completely isolate the stop-band energy, causing instability of transmission signal at the stop-band frequency. A signal feedback design may be employed to regulate the energy at the stop-band frequency. FIGS. 5 and 6 illustrate a cavity filter (duplexer) according to the prior art. According to this design, the cavity filter (duplexer) A defines a plurality of resonance chambers A01 in a resonant space A0 therein, a channel Al in communication between each two adjacent resonance chambers A01, an antenna port A2 at the center of the resonant space A0 for transmitting/receiving signals, and two signal input/output ports A3 at two distal ends of the resonant space A0 for signal transmission. Signals received (or transmitted) by the antenna port A2 are filtered through the resonance chambers A01 and then outputted by the signal input/output ports A3. According to this design, when a signal goes through the resonance chambers A01, attenuated signal components will be diffused to interfere with the performance of the cavity filter, affecting signal receiving or transmitting stability. As illustrated in FIG. 7, the frequency flatness of the stop-band ranges from 66 dB~74 dB. This wide flatness range causes signal instability.

Therefore, it is desirable to provide a cavity filter (duplexer), which enhances signal receiving/transmitting stability within a predetermined receivable range.

SUMMARY OF THE INVENTION

The present invention has been accomplished under the circumstances in view. It is one object of the present invention to provide a cavity filter, which comprises two series of resonance chambers bilaterally connected between an antenna port and two opposing signal input/output ports in a resonant space to provide a cross-coupling feedback, getting better stop-band flatness and improving the quality of the signal received by the signal receiver using the cavity filter.

To achieve this and other objects of the present invention, a cavity filter comprises a base member and a cover member. The base member comprises a resonant space, an antenna port disposed at the center of the resonant space, two signal input/output ports respectively disposed at two distal ends of the resonant space for signal input/output, two series of resonance chambers respectively and connected between the signal input/output ports and the antenna port, a channel cut through each partition plate between the first and last resonance chambers and between the second and last second resonance chambers, and a signal guide-way connected between each two adjacent resonance chambers of each of the two series of resonance chambers. The cover member is covered on the base member, carrying multiple frequency-adjusting rods of a frequency adjustment device for tuning by the user to adjust the frequency and bandwidth in the resonant space subject to the desired frequency range and to adjust the reverse coupling effects in the resonant space for enabling the series of resonance chambers and the respective channels to provide a cross-coupling feedback. Thus, usable feedback frequency components can be obtained from attenuated signal components to compensate for stop-band attenuation components, and smaller frequency components can be provided to get better stop-band flatness. Therefore, the cavity filter greatly improves the quality of the signal received by the signal receiver (such as wireless communication base station, satellite communication equipment or microwave transmitter/receiver antenna) that is used with the cavity filter, enhancing signal transmission stability and avoiding interference of noises.

Further, according to the preferred embodiment of the present invention, each series of resonance chambers ranges from 1st to 9th. Further, a partition plate is respectively set between the 1st resonance chamber and 9th resonance chamber and between the 2nd resonance chamber and 8th resonance chamber of each of the two series of resonance chambers, and a channel cut through each partition plate in communication between the 1st resonance chamber and 9th resonance chamber or between the 2nd resonance chamber and 8th resonance chamber of each associating series of resonance chambers. Further, a signal guide-way connected between each two adjacent resonance chambers of each of the two series of resonance chambers. Thus, the cavity filter can provide enhanced cross-coupling effects, enhancing signal feedback.

DETAILED DESCRIPTION OF THE PREFERRED EMBODIMENT

Figure 1:
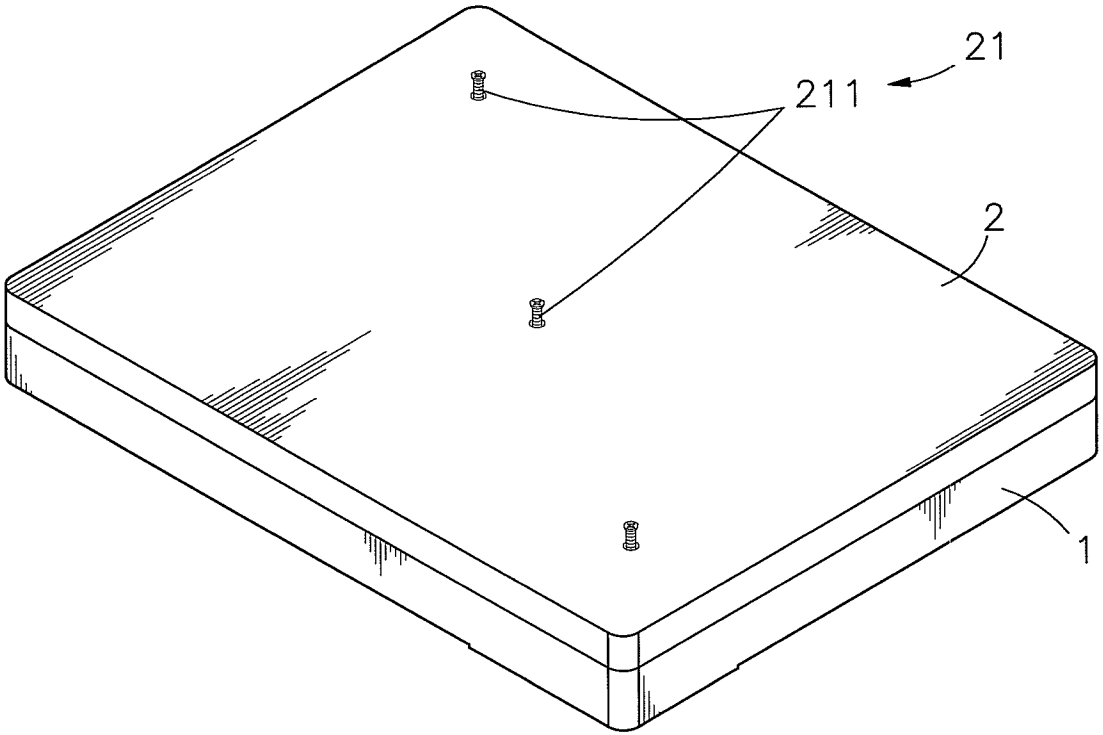
FIG. 1 is an elevational view of a cavity filter in accordance with the present invention.
Figure 2:
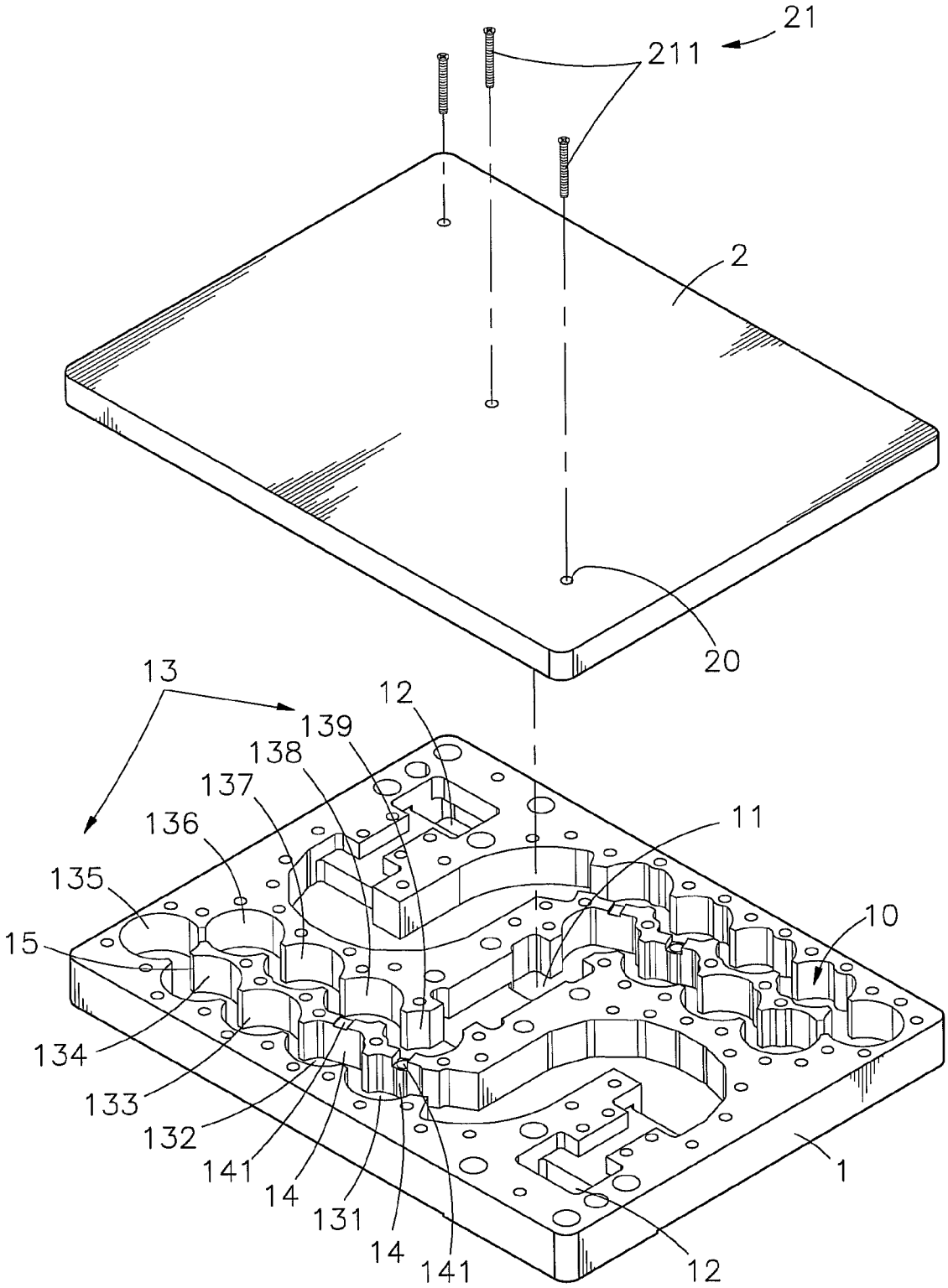
FIG. 2 is an exploded view of the cavity filter in accordance with the present invention.
Figure 3:
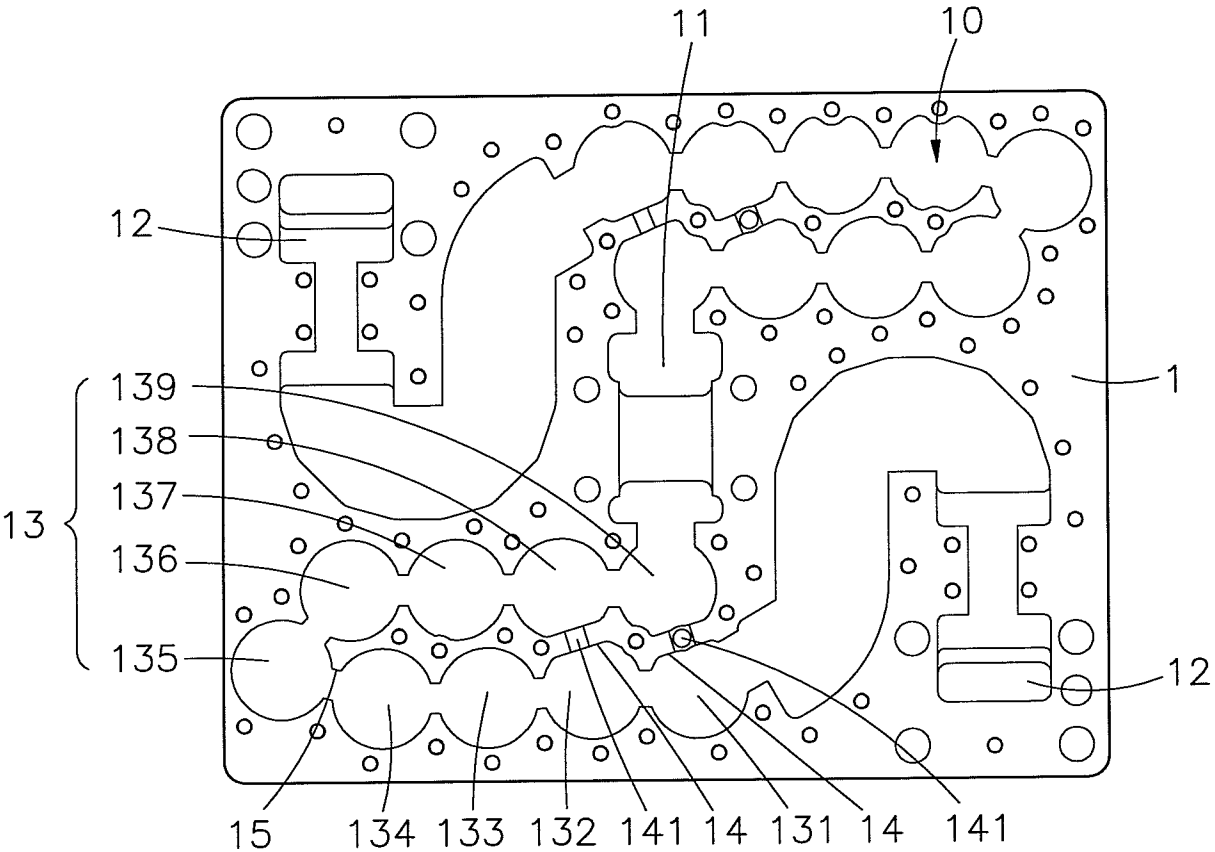
FIG. 3 is a top view of the base member of the cavity filter in accordance with the present invention.
Figure 4:
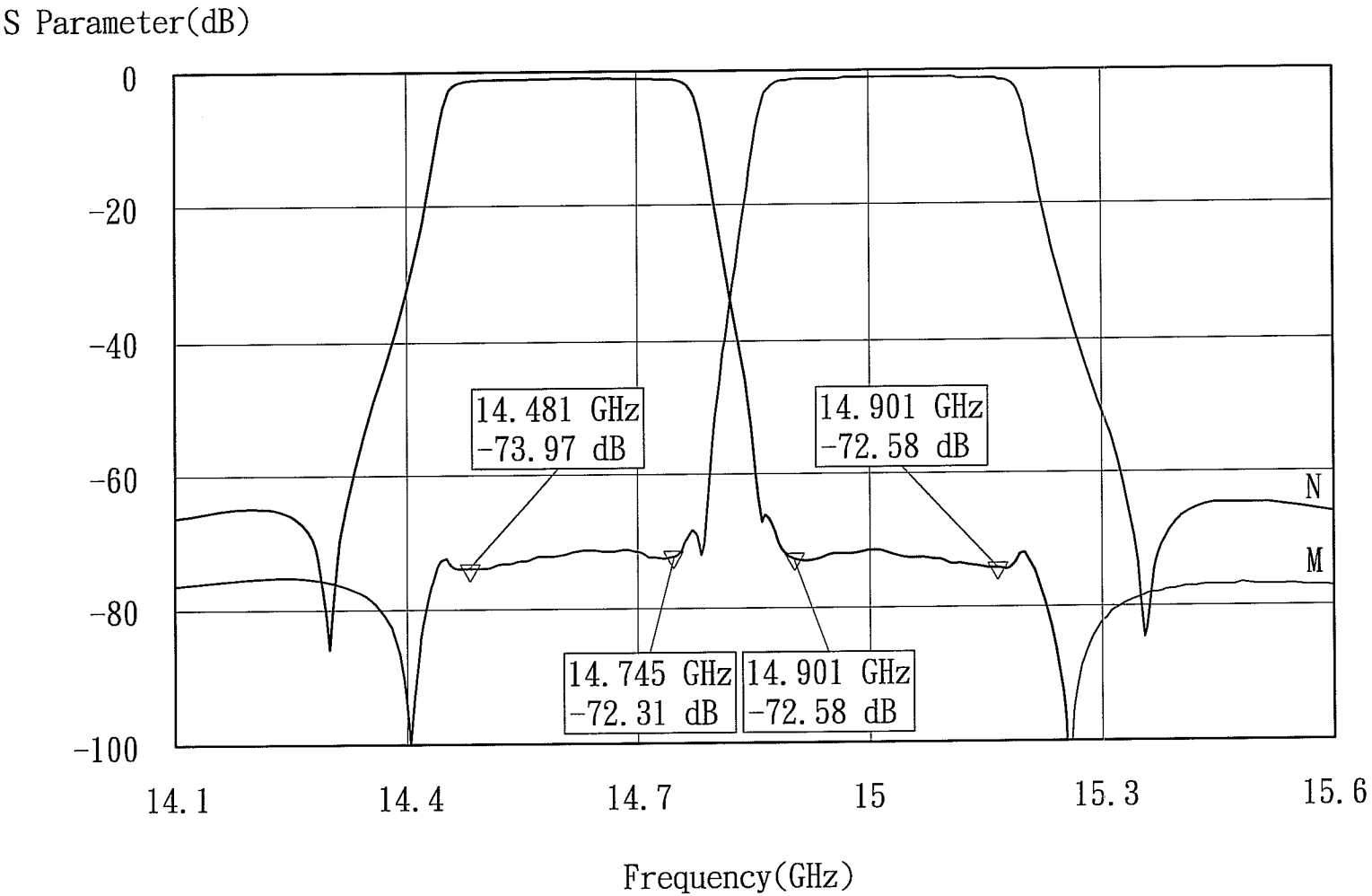
FIG. 4 is a diagram of a filtered signal obtained according to the present invention.
Figure 5:
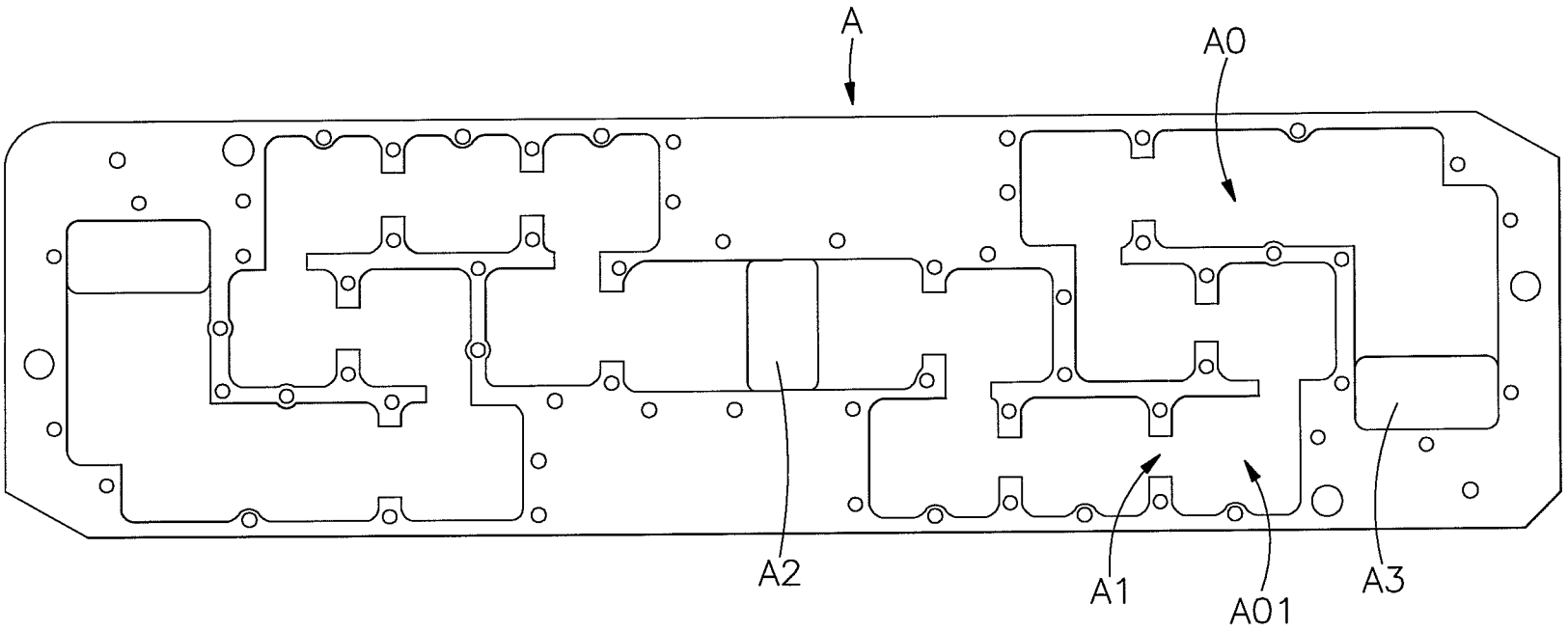
PRIOR ART FIG.5
FIG. 5 is a top view of a cavity filter according to the prior art.
Figure 6:
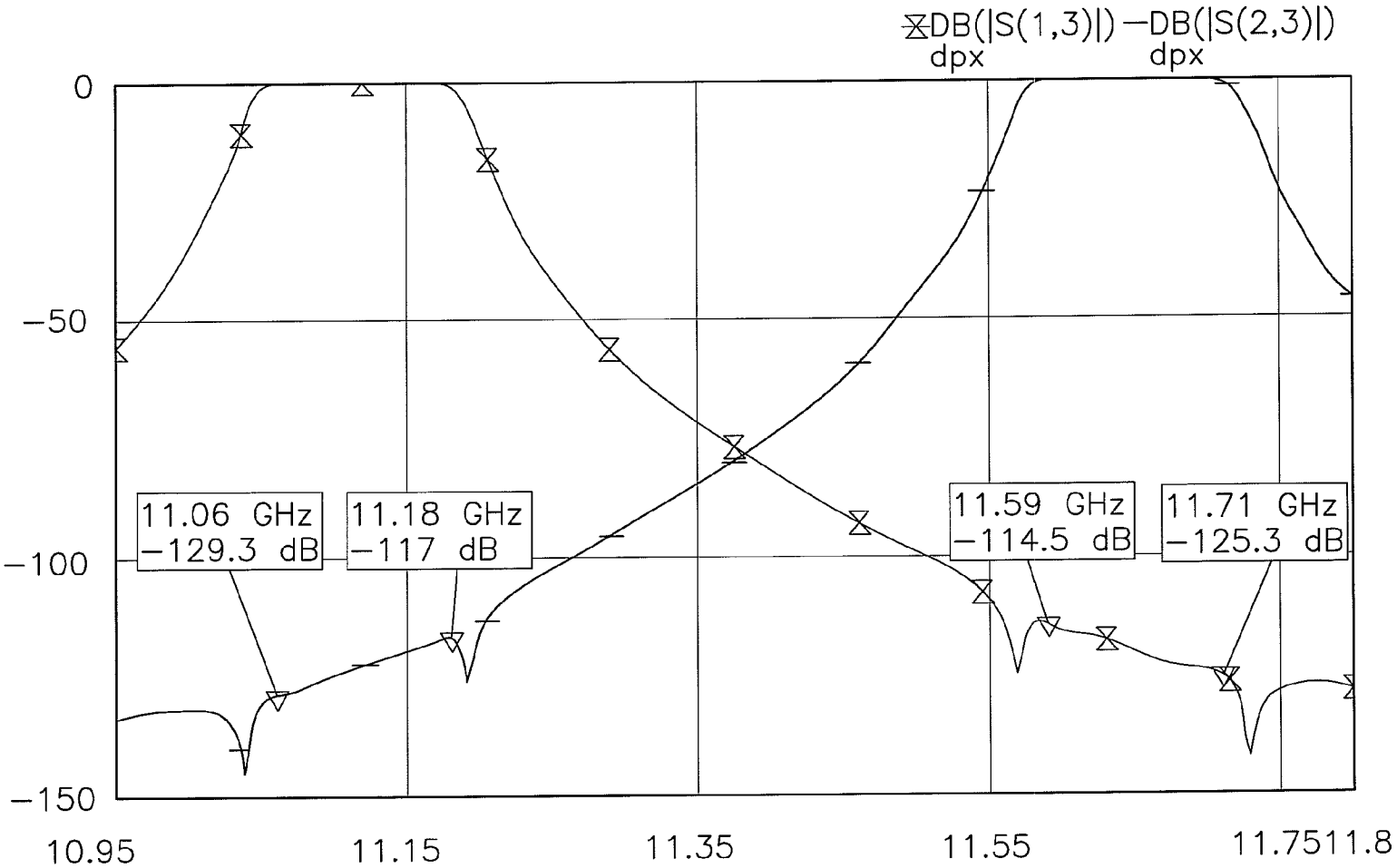
PRIOR ART FIG. 6
FIG. 6 is a diagram of a filtered signal obtained according to the prior art cavity filter.
Figure 7:
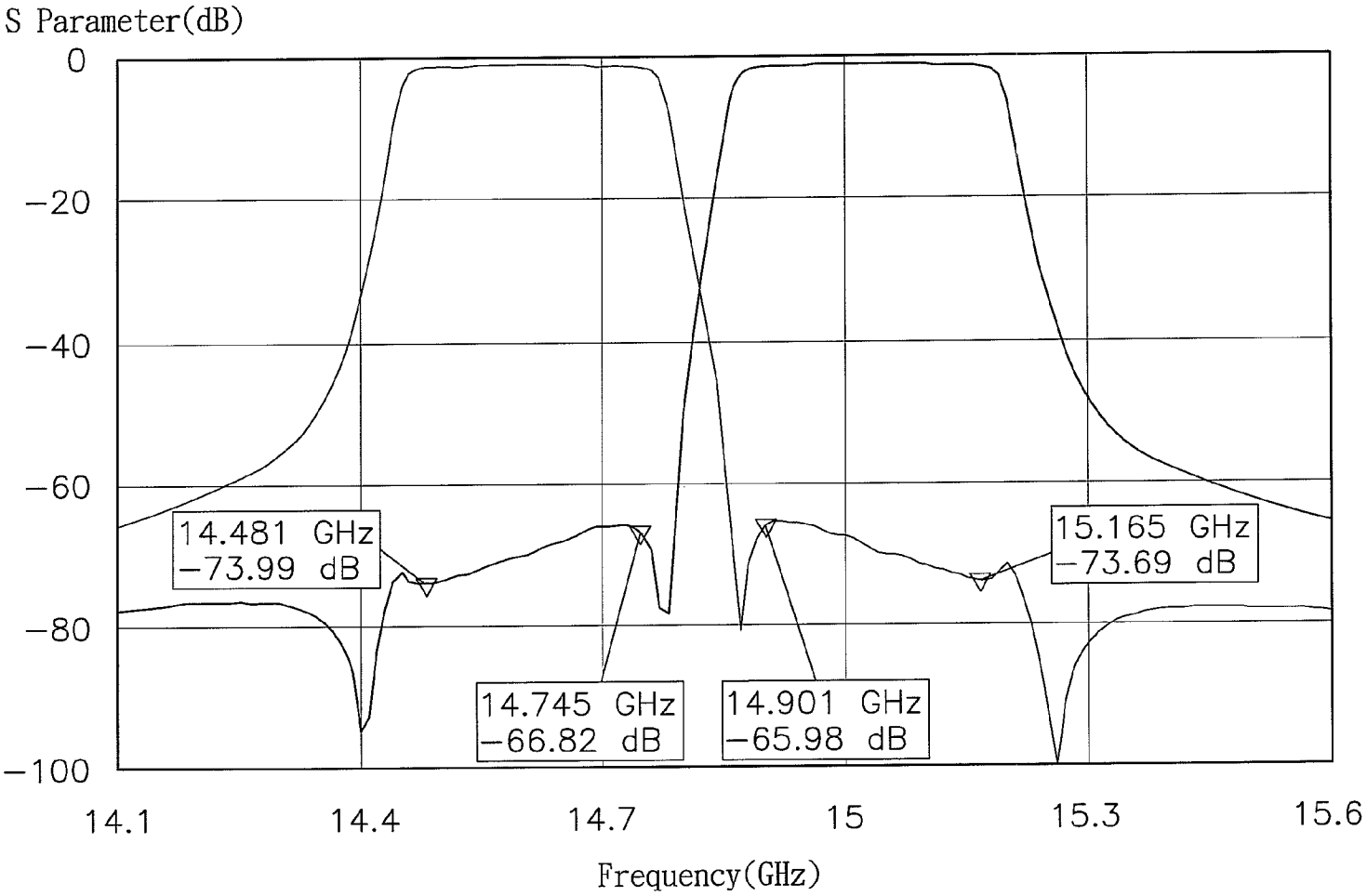
PRIOR ART FIG. 7
FIG. 7 is a diagram of a filtered signal obtained according to another prior art cavity filter.

Referring to FIGS. 1~4, a cavity filter in accordance with the present invention is shown comprising a base member 1 and a cover member 2.

The base member 1 defines therein a resonant space 10, an antenna port 11 disposed at the center of the resonant space 10, two signal input/output ports 12 respectively disposed at two distal ends of the resonant space 10 for signal input/output, two series of resonance chambers 13 respectively connected between the signal input/output ports 12 and the antenna port 11, each series of resonance chambers 13 ranging from 1st to 9th, a partition plate 14 respectively set between the $1^{st}$ resonance chamber 131 and $9^{th}$ resonance chamber 139 and between the $2^{nd}$ resonance chamber 132 and $8^{th}$ resonance chamber 138 of each of the two series of resonance chambers 13, a channel 141 cut through each partition plate 14 in communication between the $1^{st}$ resonance chamber 131 and $9^{th}$ resonance chamber 139 or between the $2^{nd}$ resonance chamber 132 and $8^{th}$ resonance chamber 138 of each associating series of resonance chambers 13, and a signal guide-way 15 connected between each two adjacent resonance chambers 131~139 of each of the two series of resonance chambers 13.

The cover member 2 is adapted for closing the base member 1, having a plurality through holes 20 cut through opposing top and bottom sides thereof for receiving frequency-adjusting rods 211 of a frequency adjustment device 21.

During installation, the cover member 2 is covered on the base member 1 over the resonant space 10, and then the frequency-adjusting rods 211 of the frequency adjustment device 21 are respectively threaded into the respective through holes 20 of the cover member 2 and tuned to adjust the frequency and bandwidth in the resonant space 10 subject to the desired frequency range and to further adjust the reverse coupling effects in the resonant space 10, enabling the series of resonance chambers 13 and the respective channels 141 to provide cross-coupling feedback. The arrangement of the partition plate 14 between the $1^{st}$ resonance chamber 131 and $9^{th}$ resonance chamber 139 of each of the two series of resonance chambers 13 and the associating channel 141 allows accurate adjustment of compensation of the frequency components of stop-band. Further, the arrangement of the partition plate 14 between the $2^{nd}$ resonance chamber 132 and 8th resonance chamber 138 of each of the two series of resonance chambers 13 and the associating channel 141 not only can adjust compensation of the frequency components of stop-band but also can provide smaller frequency components to get better stop-band flatness, enhancing cross-coupling feedback.

According to the aforesaid design, the two series of resonance chambers 13 are respectively connected between the signal input/output ports 12 and the antenna port 11 in the resonant space 10; each series of resonance chambers 13 includes $1^{st}$ resonance chamber 131, $2^{nd}$ resonance chamber 132, $3^{rd}$ resonance chamber 133, $4^{th}$ resonance chamber 134, $5^{th}$ resonance chamber 135, $6^{th}$ resonance chamber 136, $7^{th}$ resonance chamber 137, $8^{th}$ resonance chamber 138 and $9^{th}$ resonance chamber 139; the $1^{st}$ resonance chamber 131 of each series of resonance chambers 13 is also kept in communication between one respective signal input/output port 12 and the associating $9^{th}$ resonance chamber 139; the $9^{th}$ resonance chamber 139 of each series of resonance chambers 13 is kept in communication between the antenna port 11 and the associating $1^{st}$ resonance chamber 131. Thus, a detoured signal circulation loop is formed in the resonant space 10 inside the base member 1, enhancing resonance and harmonic.

During application, signal received (or transmitted) by the antenna port 11 is transmitted through the series of resonance chambers 13 in the resonant space 10 for fetching frequency components within a predetermined range. At this time, the frequency-adjusting rods 211 of the frequency adjustment device 21 are respectively tuned to adjust the frequency and bandwidth in the resonant space 10 subject to the desired frequency range and also to adjust the cross coupling effects in the series of resonance chambers 13. Subject to cross-coupling feedback operation of the series of resonance chambers 131~139 and the respective channels 141, usable feedback frequency components are obtained from attenuated signal components to compensate for stop-band attenuation components, and smaller frequency components are provided to get stop-band flatness to the range about 72~74 dB, improving the quality of the signal received by the signal receiver (such as wireless communication base station, satellite communication equipment or microwave transmitter/receiver antenna) that is used with the cavity filter, enhancing signal transmission stability, and avoiding interference of noises.

In conclusion, the invention provides a cavity filter comprising a base member 1, which comprises a resonant space 10, an antenna port 11 disposed at the center of the resonant space 10, two signal input/output ports 12 respectively disposed at the two distal ends of the resonant space 10 for signal input/output, two series of resonance chambers 13 respectively connected between the signal input/output ports 12 and the antenna port 11, each series of resonance chambers 13 ranging from $1^{st}$ to $9^{th}$, a partition plate 14 respectively set between the $1^{st}$ resonance chamber 131 and $9^{th}$ resonance chamber 139 and between the $2^{nd}$ resonance chamber 132 and $8^{th}$ resonance chamber 138 of each of the two series of resonance chambers 13, a channel 141 cut through each partition plate 14 in communication between the $1^{st}$ resonance chamber 131 and 9 $^{th}$ resonance chamber 139 or between the $2^{nd}$ resonance chamber 132 and $8^{th}$ resonance chamber 138 of each associating series of resonance chambers 13, and a signal guide-way 15 connected between each two adjacent resonance chambers 131~139 of each of the two series of resonance chambers 13, and a cover member 2 covering the base member 1 and carrying multiple frequency-adjusting rods 211 of a frequency adjustment device 21 for tuning by the user to adjust the frequency and bandwidth in the resonant space 10 subject to the desired frequency range and to adjust the reverse coupling effects in the resonant space 10 for enabling the series of resonance chambers 13 and the respective channels 141 to provide a cross-coupling feedback. Thus, usable feedback frequency components can be obtained from attenuated signal components to compensate for stop-band attenuation components, and smaller frequency components can be provided to get stop-band flatness. Therefore, the cavity filter greatly improves the quality of the signal received by the signal receiver (such as wireless communication base station, satellite communication equipment or microwave transmitter/receiver antenna) that is used with the cavity filter, enhancing signal transmission stability and avoiding interference of noises.

In actual practice, the cavity filter of the present invention has the features as described hereinafter.

The base member of the cavity filter defines therein a resonant space, two series of resonance chambers ranging from 1st through 9th and disposed at two opposite lateral sides and respectively connected between two opposing signal input/output ports at two distal ends of the resonant space and an antenna port at the center of the resonant space to provide cross-coupling feedback, improving the quality of the signal received by the signal receiver using the cavity filter and enhancing signal transmission performance.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A cavity filter, comprising:

a base member comprising a resonant space defined therein, an antenna port, which runs through a thickness direction of the filter, two signal input/output ports respectively disposed at two distal ends of said resonant space for signal input/output, two series of resonance chambers respectively connected between said signal input/output ports and said antenna port, the antenna port being disposed at the center of the two series of resonance chambers, and the first and last resonance chambers of each said series of resonance chambers and the second and the second to last resonance chambers of each said series of resonance chambers are directly separated by a respective partition plate with a channel cut therethrough; and a cover member covered on said base member to close said resonant space, said cover member carrying a plurality of frequency-adjusting rods of a frequency adjustment device for tuning by a user to adjust the frequency and bandwidth in said resonant space.

2. The cavity filter as claimed in claim 1, wherein each said series of resonance chambers ranges from first to ninth resonance chambers, the first resonance chamber of each said series of resonance chambers being kept in communication with the associating ninth resonance chamber through the associating channel.

3. The cavity filter as claimed in claim 2, wherein each said series of resonance chambers has the ninth resonance chamber thereof connected to said antenna port, the first resonance chamber thereof connected between the respective signal input/output port and the associating ninth resonance chamber through the associating channel, and the second resonance chamber, third resonance chamber, fourth resonance chamber, fifth resonance chamber, sixth resonance chamber, seventh resonance chamber and eighth resonance chamber thereof connected in series in a proper order between the associating first resonance chamber and the associating ninth resonance chamber.

4. The cavity filter as claimed in claim 3, wherein each said series of resonance chambers comprises a signal guide-way connected between respective adjacent resonance chambers thereof.

* * * * *